US011521553B2

(12) United States Patent
Hu

(10) Patent No.: US 11,521,553 B2
(45) Date of Patent: Dec. 6, 2022

(54) GOA CIRCUIT AND DISPLAY PANEL

(71) Applicant: Shenzhen China Star Optoelectronics Semiconductor Display Technology Co., LTD., Guangdong (CN)

(72) Inventor: Xiaobin Hu, Guangdong (CN)

(73) Assignee: Shenzhen China Star Optoelectronics Semiconductor Display Technology Co., LTD., Guangdong (CN)

( * ) Notice: Subject to any disclaimer, the term of this patent is extended or adjusted under 35 U.S.C. 154(b) by 86 days.

(21) Appl. No.: 17/055,345

(22) PCT Filed: Jul. 10, 2020

(86) PCT No.: PCT/CN2020/101359
§ 371 (c)(1),
(2) Date: Nov. 13, 2020

(87) PCT Pub. No.: WO2021/248614
PCT Pub. Date: Dec. 16, 2021

(65) Prior Publication Data

US 2022/0189404 A1 Jun. 16, 2022

(30) Foreign Application Priority Data

Jun. 9, 2020 (CN) ..... 202010517010.8

(51) Int. Cl.
*G09G 3/3266* (2016.01)

(52) U.S. Cl.
CPC ... *G09G 3/3266* (2013.01); *G09G 2300/0408* (2013.01); *G09G 2310/08* (2013.01); *G09G 2320/045* (2013.01)

(58) Field of Classification Search
CPC .. G09G 3/3266; G09G 3/3677; G09G 3/3648; G09G 3/3674; G09G 3/3696; G09G 2310/0286; G09G 2310/08; G09G 2310/0267; G09G 2310/0289; G09G 2300/0408; G09G 2300/0426;
(Continued)

(56) References Cited

U.S. PATENT DOCUMENTS 8,019,039 B1 * 9/2011 Tsai ..... G11C 19/28 377/79
2011/0044423 A1 2/2011 Lin
2013/0147692 A1 6/2013 Yamashita et al.
(Continued)

FOREIGN PATENT DOCUMENTS

CN 101667461 A 3/2010
CN 101853705 A 10/2010
(Continued)

*Primary Examiner* — Dong Hui Liang
(74) *Attorney, Agent, or Firm* — PV IP PC; Wei Te Chung; Ude Lu

(57) ABSTRACT

A GOA circuit and a display panel are provided. The GOA circuit and the display panel decrease thin film transistors required by an inverter in a circuit structure. A thin film transistor number is decreased, and an area occupied by a GOA space can be effectively decreased, which facilitates decreasing of border sizes of panels. Gates of thin film transistors of the GOA circuit are controlled by clock signals that have not been attenuated, which can prevent failure resulting from an attenuated cascaded signal caused by threshold voltage drifting of thin film transistors.

10 Claims, 3 Drawing Sheets

(58) Field of Classification Search
CPC ..... G09G 2300/0809; G09G 2300/04; G09G 2320/0214; G09G 2320/043
See application file for complete search history.

(56) References Cited

U.S. PATENT DOCUMENTS

| | | | | |
|---|---|---|---|---|
| 2016/0071614 | A1* | 3/2016 | Lee | G09G 5/006 377/67 |
| 2016/0125830 | A1 | 5/2016 | Xiao | |
| 2016/0260403 | A1* | 9/2016 | Dai | G09G 3/3696 |
| 2016/0267832 | A1* | 9/2016 | Dai | G09G 3/2092 |
| 2016/0275895 | A1* | 9/2016 | Dai | G09G 3/36 |
| 2017/0162151 | A1* | 6/2017 | Cao | G09G 3/3677 |
| 2018/0211583 | A1* | 7/2018 | Wang | G09G 3/3266 |
| 2019/0019470 | A1* | 1/2019 | Zeng | G09G 3/20 |
| 2019/0385556 | A1 | 12/2019 | Guan | |

FOREIGN PATENT DOCUMENTS

| | | | |
|---|---|---|---|
| CN | 102419949 | A | 4/2012 |
| CN | 102930814 | A | 2/2013 |
| CN | 104332146 | A | 2/2015 |
| CN | 104464660 | A | 3/2015 |
| CN | 107134271 | A | 9/2017 |
| CN | 107799083 | A | 3/2018 |
| CN | 108091308 | A | 5/2018 |
| CN | 109616068 | A | 4/2019 |
| CN | 110021278 | A | 7/2019 |

* cited by examiner

GOA CIRCUIT AND DISPLAY PANEL

FIELD OF INVENTION

The present invention relates to the field of display technology, and especially to a gate driver on array (GOA) circuit and a display panel.

BACKGROUND OF INVENTION

Gate driver on array (GOA) technology is advantageous to a narrow-border display screen design and decreases costs. It has extensive researches and wide applications.

SUMMARY OF INVENTION

FIG. 1 is a general single stage GOA circuit. FIG. 2 is a timing diagram of the GOA circuit. In the GOA circuit, a threshold voltage of thin film transistors drifts after operating for a long time, which leads to attenuation of output signals ST(N), Q(N), and G(N). Wherein, a conducting state and a turn-off state of thin film transistors having gates controlled by attenuated signals (such as T11, T31, T41, T25, T52, and T54 in FIG. 1) will further deteriorate, which leads to further attenuation of the output signals. Such kind of unstable state will be reduced to a vicious circle, leading to a failure of the GOA circuit. In order to increase reliability of the circuit, an inverter consisting of thin film transistors in FIG. 1 (T51, T52, T53, T54) and a node voltage will be added to maintain thin film transistor T42, T26, and T32. However, on the one hand, this approach increases many thin film transistors, resulting in a larger area occupied by the GOA circuit and a wider border of the panel. On the other, gates of T52 and T54 of the inverter are also controlled by an attenuated signal Q(N), and a vicious circle results from electric potential competition of node KN and node Q(N) in FIG. 1 still exists, which easily leads to a failure.

The present invention is to provide a GOA circuit that decreases a thin film transistor number of the GOA circuit and increases stability of the GOA circuit as well.

The present invention provides a GOA circuit that includes a plurality of cascaded GOA circuit units, wherein an n-stage GOA circuit unit includes a pull-up control circuit unit 101, a pull-up circuit unit 102, a transfer circuit unit 103, a pull-down circuit unit 104, and a capacitor Cb; wherein the pull-up control circuit unit 101, the pull-up circuit unit 102, the transfer circuit unit 103, the pull-down circuit unit 104, a pull-down maintenance circuit unit 105, and the capacitor Cb are all electrically connected to a first node QN; the pull-up circuit unit 101 receives a clock signal CKN−1 of an (n−1)-stage GOA circuit unit, and a start trigger signal STV or a cascaded signal STN−1 of the (n−1)-stage GOA circuit unit to charge the first node QN to a high electric potential; the pull-up circuit unit 102 receives a clock signal CKN to pull up an output signal GN of the n-stage GOA circuit unit to a high electric potential of the clock signal CKN; the transfer circuit unit 103 receives the clock signal CKN and outputs a cascaded signal STN of the n-stage GOA circuit unit to control a pull-up control circuit unit of an (n+1)-stage GOA unit to turn on or turn off; the pull-down circuit unit 104 receives a clock signal CKN+2 of an (n+2)-stage GOA circuit unit, a first low-electric-potential direct current signal VSSQ, and a second low-electric-potential direct current signal VSSG to pull down a precharge electric potential of the first node QN, an electric potential of the cascaded signal STN of the n-stage GOA circuit unit, and an electric potential of the n-stage scan driving signal GN to a low electric potential; and the capacitor Cb is configured to provide and maintain the precharge electric potential of the first node QN, and the capacitor Cb is connected to the output signal GN of the n-stage GOA circuit unit.

Furthermore, the pull-up control circuit unit 101 includes:

A first thin film transistor T11, wherein a gate of the first thin film transistor T11 is connected to the clock signal CKN−1 of the (n−1)-stage GOA circuit unit, a drain of the first thin film transistor T11 is connected to the start trigger signal STV or the cascaded signal STN−1 of the (n−1)-stage GOA circuit unit, and a source of the first thin film transistor T11 is connected to the first node QN.

Furthermore, the pull-up circuit unit 102 includes:

A second thin film transistor T21, wherein a gate of the second thin film transistor T21 is connected to the first node QN, a drain of the second thin film transistor T21 is connected to the clock signal CKN, and a source of the second thin film transistor T21 is connected to the output signal GN of the n-stage GOA circuit unit.

Furthermore, the transfer circuit unit 103 includes:

A third thin film transistor T22, wherein a gate of the third thin film transistor T22 is connected to the first node QN, a drain of the third thin film transistor T22 is connected to the clock signal CKN, and a source of the third thin film transistor T22 outputs the cascaded signal STN of the n-stage GOA circuit unit.

Furthermore, the pull-down circuit unit 104 includes:

A fourth thin film transistor T23, wherein a gate of the fourth thin film transistor T23 is connected to the clock signal CKN+2 of the (n+2)-stage GOA circuit unit, a drain of the fourth thin film transistor T23 is connected to the cascaded signal STN of the n-stage GOA circuit unit, and a source of the fourth thin film transistor T23 is connected to the first low-electric-potential direct current signal VSSQ;

A fifth thin film transistor T31, wherein a gate of the fifth thin film transistor T31 is connected to the clock signal CKN+2 of the (n+2)-stage GOA circuit unit, a drain of the fifth thin film transistor T31 is connected to the output signal GN of the n-stage GOA circuit unit, and a source of the fifth thin film transistor T31 is connected to the second low-electric-potential direct current signal VSSG; and A sixth thin film transistor T41, wherein a gate of the sixth thin film transistor T41 is connected to the clock signal CKN+2 of the (n+2)-stage GOA circuit unit, a drain of the sixth thin film transistor T41 is connected to the first node QN, and a source of the sixth thin film transistor T41 is connected to the first low-electric-potential direct current signal VSSQ.

Furthermore, if n is equal to 1, then the drain of the first thin film transistor T11 is connected to the start trigger signal STV;

If n is greater than 1, then the drain of the first thin film transistor T11 is connected to the cascaded signal STN−1 of the (n−1)-stage GOA circuit unit.

Furthermore, duty ratios of high electric potential of the clock signals CKN−1, CKN, CKN+1, and CKN+2 are 25%, the clock signals sequentially delay, and a delay time between adjacent clock signals is 25% of a clock cycle time; the high electric potential of the clock signals is identical to a high electric potential of the start trigger signal STV; and a low electric potential of the clock signals is identical to a low electric potential of the start trigger signal STV.

Furthermore, an electric potential of the first low-electric-potential direct current signal VSSQ is identical to a low electric potential of the start trigger signal STV; and an electric potential of the second low-electric-potential direct current signal VSSG is greater than the electric potential of the first low-electric-potential direct current signal VSSQ.

Furthermore, the GOA circuit includes phase 1 to phase 5 in one period;

In phase 1, the start trigger signal STV rises, and the circuit is activated;

In phase 2, the clock signal CKN−1 and the cascaded signal STN−1 of the (n−1)-stage GOA circuit unit are simultaneously at the high electric potential, while CKN+2 is at the low electric potential, T41, T31, and T23 are turned off, and therefore the first node QN of a current stage is charged to the high electric potential, thereby turning on transistors T21 and T22;

In phase 3, the clock signal CKN−1 is at the low electric potential to turn off T11, and simultaneously the clock signal CKN changes into the high electric potential to charge output signals STN and GN to the high electric potential, wherein the output signal GN is configured to drive a current row load of a panel (driving of gate lines), and the output signal STN is cascaded to a next stage (cascaded signal) to charge a first node QN+1 of the next stage to the high electric potential;

In phase 4, the clock signal CKN changes into the low electric potential and pulls down the output signals STN and GN to the low electric potential; and In phase 5, the clock signal CKN+2 is at the high electric potential to turn on T41, and to pull the first node QN to the low electric potential, thereby turning off transistors T21 and T22.

The present invention further provides a display panel that includes the GOA circuit.

The present invention provides a GOA circuit and a display panel that decrease thin film transistors required by an inverter in a circuit structure. A thin film transistor number is decreased, and an area occupied by a GOA space can be effectively decreased, which facilitates decreasing of border sizes of panels. Gates of thin film transistors of the GOA circuit are controlled by clock signals that have not been attenuated, which can prevent failure resulting from an attenuated cascaded signal caused by threshold voltage drifting of thin film transistors.

DETAILED DESCRIPTION OF PREFERRED EMBODIMENTS

In order to make a purpose, technical approach, and effect of the present application more clear and definite, the following describes the present application in detail using embodiments with reference to accompanying drawings. It should be understood that specific embodiments described here are merely used to explain the present application and not intended to limit the present application.

Figure 1:
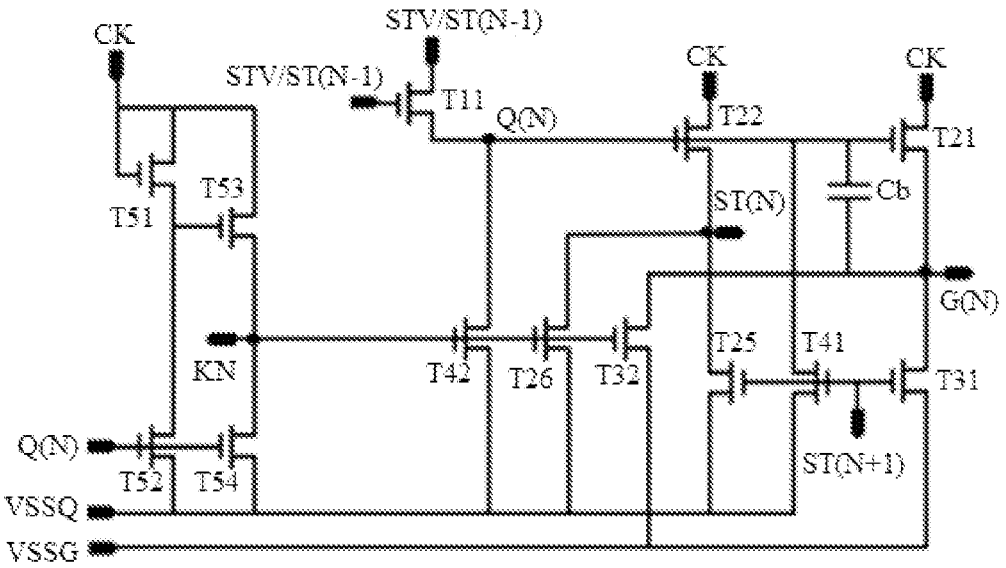
FIG. 1 (Prior Art)
FIG. 1 is a circuit diagram of a gate driver on array (GOA) circuit of conventional technology.
Figure 2:
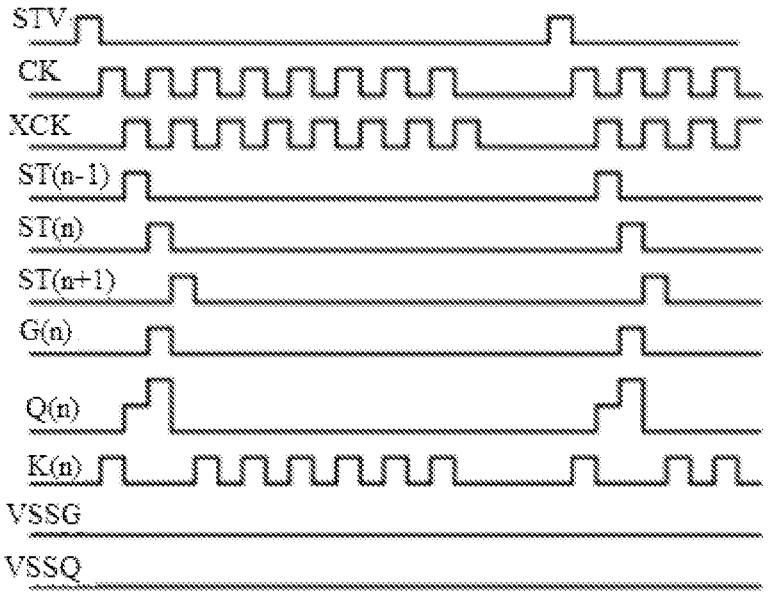
FIG. 2 (Prior Art)
FIG. 2 is a waveform of timing control and signal output of the GOA circuit of conventional technology.
Figure 3:
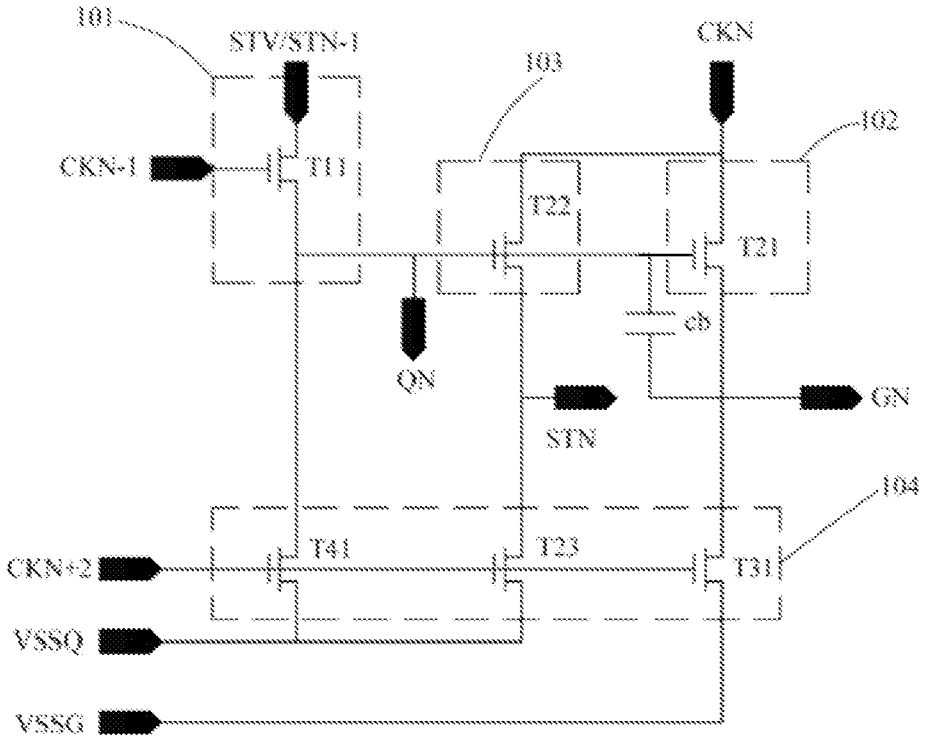
FIG. 3 is a circuit diagram of a GOA circuit according to the present invention.

As shown in FIG. 3, the present invention provides a gate driver on array (GOA) circuit that includes a plurality of cascaded GOA circuits.

Wherein, an n-stage GOA circuit unit includes a pull-up control circuit unit 101, a pull-up circuit unit 102, a transfer circuit unit 103, a pull-down circuit unit 104, and a capacitor Cb.

The pull-up control circuit unit 101, the pull-up circuit unit 102, the transfer circuit unit 103, the pull-down circuit unit 104, a pull-down maintenance circuit unit 105, and the capacitor Cb are all electrically connected to a first node QN.

The pull-up circuit unit 101 receives a clock signal CKN−1 of an (n−1)-stage GOA circuit unit, and a start trigger signal STV or a cascaded signal STN−1 of the (n−1)-stage GOA circuit unit, to charge the first node QN in the circuit to a high electric potential.

The pull-up control circuit unit 101 includes a first thin film transistor T11, wherein a gate of the first thin film transistor T11 is connected to the clock signal CKN−1 of the (n−1)-stage GOA circuit unit, a drain of the first thin film transistor T11 is connected to the start trigger signal STV or the cascaded signal STN−1 of the (n−1)-stage GOA circuit unit, and a source of the first thin film transistor T11 is connected to the first node QN.

The pull-up circuit unit 102 receives a clock signal CKN to pull up an output signal GN of the n-stage GOA circuit unit to a high electric potential of the clock signal CKN.

The pull-up circuit unit 102 includes a second thin film transistor T21, wherein a gate of the second thin film transistor T21 is connected to the first node QN, a drain of the second thin film transistor T21 is connected to the clock signal CKN, and a source of the second thin film transistor T21 is connected to the output signal GN of the n-stage GOA circuit unit.

The transfer circuit unit 103 receives the clock signal CKN and outputs a cascaded signal STN of the n-stage GOA circuit unit, to control turning on or turning off of a pull-up control circuit unit of an (n+1)-stage GOA unit.

The transfer circuit unit 103 includes:

A third thin film transistor T22, wherein a gate of the third thin film transistor T22 is connected to the first node QN, a drain of the third thin film transistor T22 is connected to the clock signal CKN, and a source of the third thin film transistor T22 outputs the cascaded signal STN of the n-stage GOA circuit unit.

The pull-down circuit unit 104 receives a clock signal CKN+2 of an (n+2)-stage GOA circuit unit, a first low-electric-potential direct current signal VSSQ, and a second low-electric-potential direct current signal VSSG, to pull down precharge of the first node QN, and pull down electric potential of the cascaded signal STN of the n-stage GOA circuit unit and of the n-stage scan driving signal GN to a low electric potential.

The pull-down circuit unit 104 includes:

A fourth thin film transistor T23, wherein a gate of the fourth thin film transistor T23 is connected to the clock signal CKN+2 of the (n+2)-stage GOA circuit unit, a drain of the fourth thin film transistor T23 is connected to the cascaded signal STN of the n-stage GOA circuit unit, and a source of the fourth thin film transistor T23 is connected to the first low-electric-potential direct current signal VSSQ;

A fifth thin film transistor T31, wherein a gate of the fifth thin film transistor T31 is connected to the clock signal CKN+2 of the (n+2)-stage GOA circuit unit, a drain of the fifth thin film transistor T31 is connected to the output signal GN of the n-stage GOA circuit unit, and a source of the fifth thin film transistor T31 is connected to the second low-electric-potential direct current signal VSSG; and A sixth thin film transistor T41, wherein a gate of the sixth thin film transistor T41 is connected to the clock signal CKN+2 of the (n+2)-stage GOA circuit unit, a drain of the sixth thin film transistor T41 is connected to the first node QN, and a source of the sixth thin film transistor T41 is connected to the first low-electric-potential direct current signal VSSQ.

The capacitor Cb is configured to provide and maintain a precharge electric potential of the first node QN, and the capacitor Cb is connected to the output signal GN of the n-stage GOA circuit unit.

Furthermore, if n is equal to 1, then the drain of the first thin film transistor T11 is connected to the start trigger signal STV; if n is greater than 1, then the drain of the first thin film transistor T11 is connected to the cascaded signal STN−1 of the (n−1)-stage GOA circuit unit.

Figure 4:
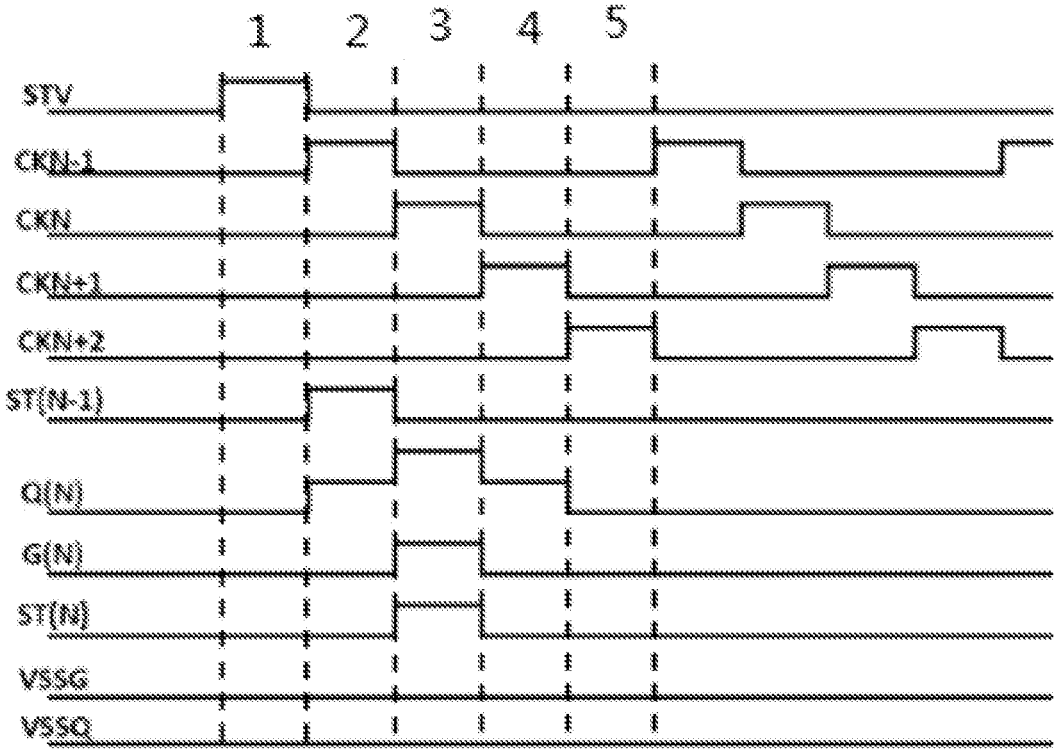
FIG. 4 is a waveform of timing control and signal output of the GOA circuit according to the present invention.

FIG. 4 is a timing control diagram according to the present invention. Wherein, duty ratios of high electric potential of the clock signals CKN−1, CKN, CKN+1, and CKN+2 are 25%. The clock signals sequentially delay, and a delay time between adjacent clock signals is 25% of a clock cycle time.

The high electric potential of the clock signals is identical to a high electric potential of the start trigger signal STV, and a low electric potential of the clock signals is identical to a low electric potential of the start trigger signal STV.

An electric potential of the first low-electric-potential direct current signal VSSQ is identical to a low electric potential of the start trigger signal STV, and an electric potential of the second low-electric-potential direct current signal VSSG is greater than the electric potential of the first low-electric-potential direct current signal VSSQ.

Referring again to FIG. 4, in one period, in phase 1, the start trigger signal STV rises, and the circuit is activated; in phase 2, the clock signal CKN−1 and the cascaded signal STN−1 of the (n−1)-stage GOA circuit unit are simultaneously at the high electric potential, while CKN+2 is at the low electric potential, T41, T31, and T23 are turned off, and therefore the first node QN of a current stage is charged to the high electric potential, thereby turning on transistors T21 and T22; in phase 3, the clock signal CKN−1 is at the low electric potential and turns off T11, and simultaneously the clock signal CKN changes into the high electric potential and charges output signals STN and GN to the high electric potential, wherein the output signal GN is configured to drive a current row load of a panel (driving of gate lines), and the output signal STN is cascaded to a next stage (cascaded signal) to charge a first node QN+1 of the next stage to the high electric potential; in phase 4, the clock signal CKN changes into the low electric potential and pulls down the output signals STN and GN to the low electric potential; and in phase 5, the clock signal CKN+2 is at the high electric potential, turns on T41, and pulls the first node QN to the low electric potential, thereby turning off transistors T21 and T22.

Afterward, in each period, the clock signal CKN+2 turns on T31, T41, and T23 once, and maintains GN, QN, and STN at a corresponding low electric potential, thereby contributing to a pull-down maintenance effect.

The present invention provides a GOA circuit that decreases thin film transistors required by an inverter in a circuit structure. A thin film transistor number is decreased, and an area occupied by a GOA space can be effectively decreased, which facilitates decreasing of border sizes of panels. Gates of thin film transistors of the GOA circuit are controlled by clock signals that have not been attenuated, which can prevent failure resulting from an attenuated cascaded signal caused by threshold voltage drifting of thin film transistors.

The GOA circuit is for a low temperature poly-silicon (LTPS) panel or for an organic light-emitting diode (OLED) panel.

The first to twelfth thin film transistors are all p-channel thin film transistors or all n-channel thin film transistors.

The present invention further provides a display panel that includes the above-mentioned GOA circuit. The display panel includes an OLED display panel or a LTPS display panel.

On the one hand, the GOA circuit decreases thin film transistors required by an inverter in a circuit structure. A number of the thin film transistors is decreased, and an area occupied by a GOA space can be effectively decreased, which facilitates decreasing of border sizes of panels, and facilitates realizing of narrow border designs of the display panel.

On the other hand, gates of thin film transistors of the GOA circuit are controlled by clock signals that have not been attenuated, which can prevent failure resulting from an attenuated cascaded signal caused by threshold voltage drifting of thin film transistors, thereby increasing reliability of the display panel.

It can be understood that a person of ordinary skill in the art can make equivalent alternations or changes according to technical approaches of the present application and the invention spirit, and all the changes or alternations are within the protection scope of the appended claims of the present application.

What is claimed is:

1. A gate driver on array (GOA) circuit, comprising a plurality of cascaded GOA circuit units, wherein an n-stage GOA circuit unit comprises a pull-up control circuit unit, a pull-up circuit unit, a transfer circuit unit, a pull-down circuit unit, and a capacitor;

wherein the pull-up control circuit unit, the pull-up circuit unit, the transfer circuit unit, the pull-down circuit unit, a pull-down maintenance circuit unit, and the capacitor are all electrically connected to a first node;

the pull-up control circuit unit receives a (n−1)-th clock signal of an (n−1)-stage GOA circuit unit, and a start trigger signal or a (n−1)-th cascaded signal of the (n−1)-stage GOA circuit unit to charge the first node to a high electric potential;

the pull-up circuit unit receives a n-th clock signal to pull up an n-stage scan driving signal of the n-stage GOA circuit unit to a high electric potential of the n-th clock signal;

the transfer circuit unit receives the n-th clock signal and outputs a cascaded signal of the n-stage GOA circuit unit to control a pull-up control circuit unit of an (n+1)-stage GOA unit to turn on or turn off;

the pull-down circuit unit receives a (n+2)-th clock signal of an (n+2)-stage GOA circuit unit, a first low-electric-potential direct current signal, and a second low-electric-potential direct current signal to pull down a precharge electric potential of the first node, an electric potential of the cascaded signal of the n-stage GOA circuit unit, and an electric potential of the n-stage scan driving signal to a low electric potential; and the capacitor is configured to provide and maintain the precharge electric potential of the first node, and the capacitor is connected to the n-stage scan driving signal of the n-stage GOA circuit unit.

2. The GOA circuit as claimed in claim 1, wherein the pull-up control circuit unit comprises:

a first thin film transistor, wherein a gate of the first thin film transistor is connected to the (n−1)-th clock signal of the (n−1)-stage GOA circuit unit, a drain of the first thin film transistor is connected to the start trigger signal STV or the (n−1)-th cascaded signal of the (n−1)-stage GOA circuit unit, and a source of the first thin film transistor is connected to the first node.

3. The GOA circuit as claimed in claim 2, wherein if n is equal to 1, then the drain of the first thin film transistor is connected to the start trigger signal; if n is greater than 1, then the drain of the first thin film transistor is connected to the (n−1)-th cascaded signal of the (n−1)-stage GOA circuit unit.

4. The GOA circuit as claimed in claim 1, wherein the pull-up circuit unit comprises:

a second thin film transistor, wherein a gate of the second thin film transistor is connected to the first node, a drain of the second thin film transistor is connected to the n-th clock signal, and a source of the second thin film transistor is connected to the n-stage scan driving signal of the n-stage GOA circuit unit.

5. The GOA circuit as claimed in claim 1, wherein the transfer circuit unit comprises:

a third thin film transistor, wherein a gate of the third thin film transistor is connected to the first node, a drain of the third thin film transistor is connected to the n-th clock signal, and a source of the third thin film transistor outputs the cascaded signal of the n-stage GOA circuit unit.

6. The GOA circuit as claimed in claim 1, wherein the pull-down circuit unit comprises:

a fourth thin film transistor, wherein a gate of the fourth thin film transistor is connected to the (n+2)-th clock signal of the (n+2)-stage GOA circuit unit, a drain of the fourth thin film transistor is connected to the cascaded signal of the n-stage GOA circuit unit, and a source of the fourth thin film transistor is connected to the first low-electric-potential direct current signal;

a fifth thin film transistor, wherein a gate of the fifth thin film transistor is connected to the (n+2)-th clock signal of the (n+2)-stage GOA circuit unit, a drain of the fifth thin film transistor is connected to the n-stage scan driving signal of the n-stage GOA circuit unit, and a source of the fifth thin film transistor is connected to the second low-electric-potential direct current signal; and a sixth thin film transistor, wherein a gate of the sixth thin film transistor is connected to the (n+2)-th clock signal of the (n+2)-stage GOA circuit unit, a drain of the sixth thin film transistor is connected to the first node, and a source of the sixth thin film transistor is connected to the first low-electric-potential direct current signal.

7. The GOA circuit as claimed in claim 1, wherein duty ratios of high electric potential of the (n−1)-th clock signal, the n-th clock signal, the (n+1)-th clock signal, and the (n+2)-th clock signal are 25%, the (n−1)-th clock signal, the n-th clock signal, the (n+1)-th clock signal, and the (n+2)-th clock signal sequentially delay, and a delay time between adjacent clock signals of the (n−1)-th clock signal, the n-th clock signal, the (n+1)-th clock signal, and the (n+2)-th clock signal is 25% of a clock cycle time;

the high electric potential of the (n−1)-th clock signal, the n-th clock signal, the (n+1)-th clock signal, and the (n+2)-th clock signal is identical to a high electric potential of the start trigger signal; and a low electric potential of the (n−1)-th clock signal, the n-th clock signal, the (n+1)-th clock signal, and the (n+2)-th clock signal is identical to a low electric potential of the start trigger signal.

8. The GOA circuit as claimed in claim 1, wherein an electric potential of the first low-electric-potential direct current signal is identical to a low electric potential of the start trigger signal; and an electric potential of the second low-electric-potential direct current signal is greater than the electric potential of the first low-electric-potential direct current signal.

9. The GOA circuit as claimed in claim 1, wherein the GOA circuit comprises phase 1 to phase 5 in one period;

in phase 1, the start trigger signal rises, and the circuit is activated;

in phase 2, the (n−1)-th clock signal and the (n−1)-th cascaded signal of the (n−1)-stage GOA circuit unit are simultaneously at the high electric potential, while the (n+2)-th clock signal is at the low electric potential, a sixth thin film transistor, a fifth thin film transistor, and a fourth thin film transistor are turned off, and therefore the first node of a current stage is charged to the high electric potential, thereby turning on a second thin film transistor and a third thin film transistor;

in phase 3, the (n−1)-th clock signal is at the low electric potential to turn off, and simultaneously the n-th clock signal changes into the high electric potential to charge the cascaded signal of the n-stage GOA circuit unit and the n-stage scan driving signal GN to the high electric potential, wherein the n-stage scan driving signal is configured to drive a current row load of a panel, driving of gate lines, and the cascaded signal of the n-stage GOA circuit unit is cascaded to a next stage, cascaded signal to charge a (n+1)-th first node of the next stage to the high electric potential;

in phase 4, the n-th clock signal changes into the low electric potential and pulls down the cascaded signal of the n-stage GOA circuit unit and the n-stage scan driving signal to the low electric potential; and in phase 5, the (n+2)-th clock signal is at the high electric potential to turn on the sixth thin film transistor, and to pull the first node to the low electric potential, thereby turning off the second thin film transistor and the third thin film transistor.

10. A display panel, comprising the GOA circuit as claimed in claim 1.

* * * * *